US009334720B2

(12) United States Patent
Burnette et al.

(10) Patent No.: US 9,334,720 B2
(45) Date of Patent: May 10, 2016

(54) TUBLESS PROPPANT BLENDING SYSTEM FOR HIGH AND LOW PRESSURE BLENDING

(71) Applicant: Baker Hughes Incorporated, Houston, TX (US)

(72) Inventors: Blake C. Burnette, Tomball, TX (US); Ronnie D. Hughes, Montgomery, TX (US); D. V. Satyanarayana Gupta, The Woodlands, TX (US); Gaurav Agrawal, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 121 days.

(21) Appl. No.: 13/858,732

(22) Filed: Apr. 8, 2013

(65) Prior Publication Data

US 2014/0299321 A1 Oct. 9, 2014

(51) Int. Cl.

| | |
|---|---|
| ***E21B 43/26*** | (2006.01) |
| ***E21B 43/267*** | (2006.01) |
| *E21B 43/25* | (2006.01) |
| *E21B 43/16* | (2006.01) |

(52) U.S. Cl.

CPC ..... *E21B 43/267* (2013.01); *E21B 43/16* (2013.01); *E21B 43/25* (2013.01)

(58) Field of Classification Search

CPC ..... E21B 43/16; E21B 43/26; E21B 43/25; E21B 43/267

USPC ..... 166/308.4, 305.1, 90.1

See application file for complete search history.

(56) References Cited

U.S. PATENT DOCUMENTS

| | | | | |
|---|---|---|---|---|
| 4,078,612 | A | 3/1978 | Gallus | |
| 4,212,354 | A * | 7/1980 | Guinn | 166/303 |
| 5,799,734 | A * | 9/1998 | Norman et al. | 166/278 |
| 1,307,975 | A1 | 11/2012 | Fang Yichuan et al. | |
| 8,727,004 | B2 * | 5/2014 | Bull et al. | 166/308.4 |
| 2007/0204991 | A1 * | 9/2007 | Loree et al. | 166/280.1 |
| 2009/0301725 | A1 | 12/2009 | Case et al. | |
| 2010/0132949 | A1 * | 6/2010 | DeFosse et al. | 166/308.1 |
| 2012/0027663 | A1 | 2/2012 | Pinard Westendorf et al. | |
| 2012/0107058 | A1 | 5/2012 | Leininger | |
| 2013/0168086 | A1 * | 7/2013 | Roberts | 166/250.01 |
| 2014/0151049 | A1 * | 6/2014 | Sanborn et al. | 166/305.1 |

FOREIGN PATENT DOCUMENTS

| | | | |
|---|---|---|---|
| WO | 2008076952 A2 | 6/2008 | |
| WO | 2010071994 A1 | 7/2010 | |
| WO | WO 2012037676 A1 * | 3/2012 | 166/250.01 |

OTHER PUBLICATIONS

Aldred, Derek L., et al; "Achieve Continuous Injection of Solid Fuels into Advanced Combustion System Pressures Topical Report—Phase III Program"; http://www.osti.gov/bridge/servlets/purl/909121-3CVmT0/909121.pdf: Jun. 2007, 1-23.

* cited by examiner

*Primary Examiner* — Doug Hutton, Jr.
*Assistant Examiner* — Silvana Runyan
(74) *Attorney, Agent, or Firm* — Steve Rosenblatt

(57) ABSTRACT

Fracturing slurries are prepared on the fly using a solids pump to feed the solid such as a gel into a liquid stream of normally water for pumping downhole with a large capacity triplex pump. The solids pump is preferably a Posimetric® style which delivers the solid into the fluid pipeline in a manner that keeps fluid from backing into the solids hopper above the solids pump. A separate fluid tank is connected to a fluid pump to pressurize a suction line to a boost pump before reaching the triplex pump and pumping into the subterranean formation. The solids pump can deliver between the fluid and boost pumps in which case the solids go through the triplex pump or alternatively the solids can be delivered into the higher pressure discharge line of the triplex pump.

15 Claims, 1 Drawing Sheet

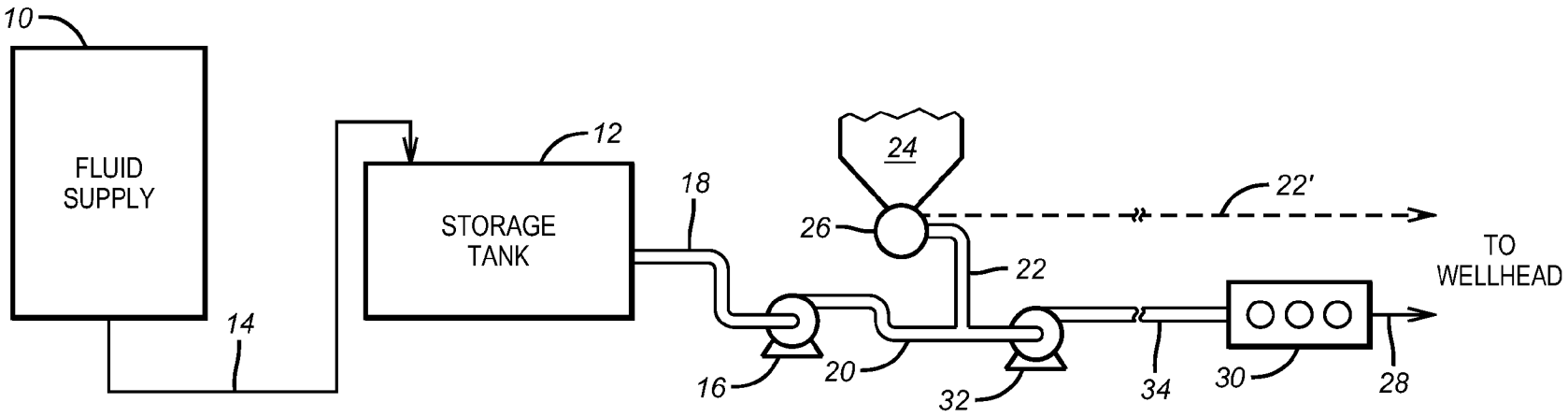
FLUID SUPPLY
10
14
STORAGE TANK
12
18
16
20
26
24
22
22'
32
34
30
28
TO WELLHEAD

TUBLESS PROPPANT BLENDING SYSTEM FOR HIGH AND LOW PRESSURE BLENDING

FIELD OF THE INVENTION

The field of the invention is blending systems for solids and fluids for subterranean use and more particularly for fracturing.

BACKGROUND OF THE INVENTION

Fracturing involves pumping large volumes at high pressure into a formation to initiate and extend fractures and later to extract hydrocarbons. The material that is pumped is invariably water with a small percentage by weight of solids such as proppants that are used to create and hold open the produced fractures with the high pressure associated with the slurry flow.

In the past the slurry was prepared at the surface using a mix tank connected to a water line. The solids were tossed into the top of the tank and significant horsepower was needed to drive one or more agitators to keep the solids from precipitating in the tank and to maintain a slurry of uniform consistency for the fracturing process that occurred at the subterranean location. The slurry would then be delivered to an inlet of a triplex pump to deliver the requisite volume and the needed pressures. These pumps are large 3 cylinder piston pumps driven by a diesel engine although more recently natural gas driven engines have been used.

Pumps that deliver solids into fluid piping systems have been used primarily in the coal fired utility industry and are marketed by General Electric Company under the trademark Posimetric®. These pumps are described and deployed in U.S. Pat. No. 8,307,975; US Publication 20120027663 and US Publication 2012/0107058.

The use of a mix tank with agitators presents issues of space that can be in short supply at some well locations as well as maintenance and operational consistency issues. The present invention seeks improve the systems for slurry preparation for use in subterranean operations, notably fracturing by elimination of the mixing equipment described above and using a solids pump to deliver to the suction or discharge of a fracturing pump that also receives the fluid supply. These and other aspects of the present invention will become more readily apparent to those skilled in the art from a review of the detailed description and the associated FIGURE while recognizing that the full scope of the invention is to be determined from the appended claims.

SUMMARY OF THE INVENTION

Fracturing slurries are prepared on the fly using a solids pump to feed the solid such as a gel into a liquid stream of normally water for pumping downhole with a large capacity triplex pump. The solids pump is preferably a Posimetric® style which delivers the solid into the fluid pipeline in a manner that keeps fluid from backing into the solids hopper above the solids pump. A separate fluid tank is connected to a fluid pump to pressurize a suction line to a boost pump before reaching the triplex pump and pumping into the subterranean formation. The solids pump can deliver between the fluid and boost pumps in which case the solids go through the triplex pump or alternatively the solids can be delivered into the higher pressure discharge line of the triplex pump. The system can be used also for cementing.

BRIEF DESCRIPTION OF THE DRAWING

The FIGURE is a schematic representation of one possible configuration for the system of the present invention and illustrates a possible alternate arrangement.

DETAILED DESCRIPTION OF THE PREFERRED EMBODIMENT

A fluid supply 10 holds water or other liquids and is connected to a storage tank 12 by line 14. The water supply is in many cases brought to a well site with 18 wheelers. Fluid pump 16 is connected by line 18 to bring the water through discharge line 20. The line 22 connects with discharge line 20 for delivery of solids, semisolids or other materials from the storage vessel 24. The solids pump 26 can deliver from the vessel 24 through line 22 or line 22 can be eliminated and the discharge from pump 26 can go directly into line 20. In an alternative embodiment the solids can be fed into line 28 that goes to the wellhead (not shown). The frac pump 30 is fed by boost pump 32 through line 34. Line 20 extends on one end to the boost pump 32. If the solids pump 26 delivers into line 20 then boost pump 32 and frac pump 30 both handle slurry. On the other hand if the solids are delivered through line 22' then pumps 30 and 32 do not see solids but the tradeoff is that the pump 26 horsepower requirement goes up substantially as the solids must be injected into a line that has orders of magnitude higher pressure than line 20. On the other hand, one of the pumps 16 or 32 can be eliminated if the solids are delivered downstream of frac pump 30.

Instead of water the fluid 10 can be a polymer based gel or non-aqueous fluid, foams, gases such as nitrogen and liquid CO2, LNG, etc. The solid material in vessel 24 can be sand, powdered cement or a dry chemical additive.

Those skilled in the art will appreciate that a fracturing or cementing system and method is described that removes the need to premix solids with a carrier fluid in an agitated tank before pumping the slurry into the subterranean location. Instead the solids are delivered to the pressurized liquid line either before or after the frac pump. Preferably the solids are directly delivered to line 20 that works at fairly low pressures as the capacities of the pumps 16 and 32 are evenly matched. Injection of solids into a lower pressure line also takes less horsepower driving the solids pump 26. Although a Posimetric® pump is preferred other solids delivery devices that compress the solid delivered near the point of discharge to prevent fluid backup into the solids pump are also contemplated. The advantages are space and reliability gains as an agitated mix tank is eliminated along with agitator horsepower requirements. in the alternative embodiment of injecting the solids downstream of frac pump 30 one of the two pumps 16 or 32 can be eliminated and less wear on the frac pump 30 is experienced as the solids bypass that pump altogether.

The above description is illustrative of the preferred embodiment and many modifications may be made by those skilled in the art without departing from the invention whose scope is to be determined from the literal and equivalent scope of the claims below:

We claim:

1. A fracturing method, comprising:

making a slurry on the fly by injecting a solid proppant in a dry state with a solids pump into a pressurized fluid pipe for initial fluid mixing in said pipe on a discharge side of an injection pump without an intervening blending tank;

pumping said slurry with said injection pump to a subterranean formation;

fracturing the formation.

2. The method of claim 1, comprising:

providing a fluid storage vessel and associated fluid pump to remove the fluid from the vessel;

directing the discharge of said fluid pump to the suction of a booster pump.

3. The method of claim 1, comprising:

using a Posimetric® pump as said solids pump.

4. The method of claim 1, comprising:

using water, a polymer based gel, non-aqueous fluid, foam, nitrogen gas, liquid CO2, or LNG as said fluid.

5. The method of claim 1, comprising:

using sand, powdered cement or a dry chemical additive as said solid.

6. The method of claim 2, comprising:

injecting the solid into a pressurized conduit between said fluid and booster pumps.

7. The method of claim 6, comprising:

providing a line from a solids pump discharge into the pressurized conduit between said fluid and booster pumps.

8. The method of claim 6, comprising:

discharging solids from the discharge connection on the solids pump at the pressurized conduit between said fluid and booster pumps.

9. The method of claim 1, comprising:

using a frac pump at a surface location for said pumping.

10. The method of claim 9, comprising:

injecting said solid upstream of said frac pump.

11. The method of claim 9, comprising:

injecting said solid downstream of said frac pump.

12. The method of claim 11, comprising:

using a booster pump upstream of said frac pump to pressurize fluid from a storage vessel.

13. The method of claim 11, comprising:

delivering the solid into the pressurized fluid conduit with a solids pump.

14. The method of claim 13, comprising:

connecting the discharge of said solids pump directly or indirectly to the pressurized fluid conduit downstream of said frac pump.

15. The method of claim 14, comprising:

using a Posimetric® pump as said solids pump.

* * * * *